US007458189B2

(12) United States Patent
Pollack

(10) Patent No.: US 7,458,189 B2
(45) Date of Patent: Dec. 2, 2008

(54) DEVICE AND METHOD TO PROVIDE AIR CIRCULATION SPACE PROXIMATE TO INSULATION MATERIAL

(76) Inventor: Robert W. Pollack, 55 Dunbow Dr., Chappaqua, NY (US) 10514

( * ) Notice: Subject to any disclaimer, the term of this patent is extended or adjusted under 35 U.S.C. 154(b) by 504 days.

(21) Appl. No.: 11/203,354

(22) Filed: Aug. 12, 2005

(65) Prior Publication Data

US 2006/0123724 A1 Jun. 15, 2006

Related U.S. Application Data

(60) Provisional application No. 60/634,823, filed on Dec. 9, 2004.

(51) Int. Cl.

| | |
|---|---|
| ***E04B 1/70*** | (2006.01) |
| ***E04B 7/00*** | (2006.01) |
| ***E02D 19/00*** | (2006.01) |
| ***E04H 7/22*** | (2006.01) |

(52) U.S. Cl. ..... 52/302.1; 52/302.2; 52/302.6; 52/95; 52/169.4

(58) Field of Classification Search ..... 52/302.1, 52/95, 302.3, 199, 198, 269, 302.6, 270, 52/169.14; 454/260

See application file for complete search history.

(56) References Cited

U.S. PATENT DOCUMENTS

| | | | | |
|---|---|---|---|---|
| 2,264,961 | A | 12/1941 | Ward | |
| 4,096,790 | A | 6/1978 | Curran | |
| 4,102,092 | A | 7/1978 | Ward | |
| 4,125,971 | A | 11/1978 | Ward | |
| 4,189,878 | A * | 2/1980 | Fitzgerald | 52/95 |
| 4,214,510 | A | 7/1980 | Ward | |
| 4,406,095 | A | 9/1983 | Slavik | |
| 4,446,661 | A | 5/1984 | Jonsson et al. | |
| 4,660,463 | A * | 4/1987 | Bottomore et al. | 454/260 |
| 5,341,612 | A | 8/1994 | Robbins | |
| 5,596,847 | A * | 1/1997 | Stephenson | 52/198 |
| 5,600,928 | A | 2/1997 | Hess et al. | |
| 5,867,956 | A | 2/1999 | Gregory et al. | |

(Continued)

OTHER PUBLICATIONS

International Search Report for Corresponding International Application PCT/US2005/44572.

*Primary Examiner*—Richard E Chilcot, Jr.
*Assistant Examiner*—Mark R Wendell
(74) *Attorney, Agent, or Firm*—Edwards Angell Palmer & Dodge LLP

(57) ABSTRACT

A spacer device is provided including (1) a body having a plurality of openings defining an openwork, to allow the passage of air therethrough when placed in contact with insulation material, and (2) a plurality of spacer struts fixedly attached to the body. The struts are configured to maintain a predetermined distance between a first side of the insulation material and a building surface. The body and struts act together to define and maintain a space between the first side of the insulation material and the building surface, for example, for ventilation. The building surface can be the bottom face of a roof, an attic floor, wall sheathing or a soundproofed demising wall, for example. The spacer device can be capable of being transported and stored together with, or as a separate item from, the insulation material, and can also be stored in nested layers. The device can also be stored in rolled form. The openwork of the device can additionally or alternatively include a sheet of entangled net filaments.

26 Claims, 8 Drawing Sheets

U.S. PATENT DOCUMENTS 6,185,895 B1 2/2001 Rettew
6,308,472 B1 * 10/2001 Coulton et al. ..... 52/198
6,346,040 B1 2/2002 Best
6,357,185 B1 3/2002 Obermeyer et al.
6,594,965 B2 * 7/2003 Coulton ..... 52/302.1
7,094,145 B2 8/2006 Rye et al.
7,143,551 B2 12/2006 Corwin
7,143,557 B1 * 12/2006 Ayers, Jr. ..... 52/302.1
7,302,776 B2 * 12/2007 Duncan et al. ..... 52/95
2002/0095882 A1 * 7/2002 Rotter ..... 52/199
2004/0216397 A1 * 11/2004 Sigmund ..... 52/95

* cited by examiner

DEVICE AND METHOD TO PROVIDE AIR CIRCULATION SPACE PROXIMATE TO INSULATION MATERIAL

CROSS-REFERENCE TO RELATED APPLICATIONS

This patent claims priority to U.S. Provisional Patent Application Ser. No. 60/634,823, filed Dec. 9, 2004.

BACKGROUND OF THE INVENTION

1. Field of the Invention

The present invention relates primarily to a device for maintaining air circulation space proximate to thermal insulation. Particularly, the present invention is directed to a device to maintain ventilation space above thermal insulation in order to expel heat and moisture from the insulation.

2. Description of Related Art

Thermal insulation is required to reduce the energy loss from structures for the purposes of maintaining comfortable interior spaces both in heating months and cooling months. The need to reduce the consumption of fossil fuels and the "greenhouse effect" has required the ever-increasing improvement in insulation values. Dimensional lumber sizes used in the framing of structures, and standard dimensions of light steel framing members have not changed significantly in many years. The depth of framing members and therefore the insulation cavity are determined by structural requirements which, for the foregoing reason, have remained fairly constant. Exterior wall, floor and roof construction is where thermal insulation is most commonly used. The ever-increasing thickness requirements for fibrous insulation, which is the most commonly-used and economical insulation type for insulating framing cavities, makes adequate ventilation of this insulation more difficult to achieve. Increased thickness of other types of insulation, such as rigid foams and the like, also present ventilation problems, particularly if the foam is porous to any degree.

Insulation used in roofs has the most crucial requirement for ventilation over the top of the insulating materials. Roofs are required to have the greatest amount of thermal insulation, since as heat rises to the highest point of a space, it creates the highest differential between inside and outside temperatures of any part of the so-called "thermal envelope" and therefore is the area of the greatest heat loss during the heating season. During the cooling season, heat from the sun heats the roof to such an extent that it becomes the greatest source of heat gain. Use of dark-colored roofing materials only worsens the problem. In the heating and cooling seasons, insulation absorbs heat in the daytime as part of the insulation cycle. That heat must be expelled during the cooler night time hours to be ready to store new heat during the next daylight period, which helps slow down heat transfer through the insulation and into the structure. If ventilation is inadequate, or non-existent, the heat will not be expelled from the insulation and the effectiveness of the system will be reduced. However, as the heat is expelled during the night and cools down, the insulation absorbs moisture, because the cool night air is usually relatively damp. Ventilation during daylight hours expels the moisture as the insulation is heated. If ventilation is not adequate, insulation can become completely saturated with moisture and ruin drywall, plaster and ceiling finishes, causing interior dripping and risking collapse of the ceiling. Prolonged and/or frequent water retention can also promote mildew, mold and rotting of the roof structure. In today's era of more "efficient" building technology with fewer places for air to penetrate to ventilate insulation, wet insulation and the aforementioned mildew and mold problems can become very serious, often affecting the health of occupants exposed to the mold. If mold is present in large quantities, it is sometimes referred to as "sick building syndrome."

For similar reasons, wall systems may require ventilation. Vapor barriers are often installed under drywall; or insulation batting is provided with an impermeable plastic or foil layer. However, if any part of the system is faulty, is improperly installed or becomes damaged, moisture can penetrate into the insulation and reduce its effectiveness and/or cause any of the aforementioned problems such as mold. Water and moisture can also penetrate insulation from the outside if external sheathing or siding is faulty. Accordingly, proper ventilation of the insulation within wall cavities can be crucial.

A variety of methods, systems and products have been developed for attempting to maintain a ventilation space proximate to thermal insulation. However, such conventional methods and systems suffer from certain significant deficiencies.

Before legislation brought about insulation requirements for roofs, floors and exterior walls, the ventilation cavity between the top of insulation (e.g., fibrous insulation) and sheathing was formed by simply having an insulation thickness less than the void depth.

As environmental concerns brought about the creation of energy construction codes, and these codes started to require greater thicknesses of insulation, it became necessary for the insulation to be installed carefully. The practice of "patting-down" the top of the insulation during installation came about and was initially sufficient. As the thicknesses of insulation continued to increase, the Rafter-Vent® product was developed. U.S. Pat. Nos. 4,125,971, 4,406,095, 5,341,612 and 5,600,928 are examples of such existing technology. Other patents such as U.S. Pat. Nos. 4,102,092, 4,214,510, 4,446,661 and 4,660,463 disclose devices concerned with maintaining ventilation over insulation at the eaves only, but do not maintain ventilation spaces over the entire length of the rafters.

The problems with the Rafter-Vent® and similar products are significant. FIGS. 6 and 7 illustrate this prior art product. FIG. 6 shows the Rafter-Vent® product used in a first orientation. When the Rafter-Vent® product is positioned as depicted, the insulation can still fluff between the contact points and block most of the airflow. Nevertheless, it still provides some ventilation to the insulation. FIG. 7 shows the Rafter-Vent® product used in a second, inverted orientation generally recommended by the manufacturer for eave venting. The bottom of the "U"-shaped cross section is against the insulation. Because the bottom surface of the "U" is a solid, relatively imperforate surface, it almost completely seals-off the insulation from the ventilation space. Additionally, because the most popularly used versions of Rafter-Vent products are made of approximately ⅜" thick styrene foam plastic, it also blocks the escape of heat via conduction from the insulation because the Rafter-Vent product itself is an insulating material. An additional drawback to the Rafter-Vent product is that it is supplied to a construction site in a nested bundle. Frequently, it is delivered along with the lumber in eight foot long bundles. Because it is fragile, very light in weight, and easily broken, and usually sits on the construction site for a long period of time before it is used, construction sites are often littered with pieces of this product. Once the bundle is opened and not carefully stored, wind can pick up the large, extremely light panels and scatter them causing litter on construction sites and the neighborhoods surrounding them.

FIG. 6 is a sectional view through several bays of roof structure and insulation illustrating use of the Rafter-Vent product in a first orientation that would provide limited possibility for maintaining ventilation to the insulation material 16. However, as is evident from FIG. 6, tightly packed insulation can still force itself into the form of the Rafter-Vent product and block ventilation.

FIG. 7 is a sectional view through several bays of roof structure and insulation illustrating the use of the Rafter-Vent product in a second orientation by installing it as recommended for eave vents. As is evident from FIG. 7, most of the insulation's surface area is sealed-off from the ventilation space by the Rafter-Vent product, as noted above, because the Rafter-Vent product is made from foam plastic, which is itself an insulator, and it effectively prevents the expulsion of built-up heat from the fibrous insulation mass. Reference numeral 15 indicates the roof sheathing, reference numeral 18 indicates the fibrous insulation mass, and reference numeral 21 indicates a typical rafter in a "cathedral" ceiling, "tray" ceiling or flat roof assembly or attic joists with storage floor boards attached.

The Rafter-Vent product thus has significant deficiencies because it does not insure a uniform ventilation space and because versions of it are frequently used incorrectly (i.e., "upside-down") rendering it ineffective for the purpose intended.

As briefly mentioned above, the method used prior to the advent of the Rafter-Vent product to form the air space was the action of the insulation installer patting the insulation down with his hand. This earlier method was, to some extent, superior to the Rafter-Vent concept since airflow was not essentially completely blocked by an impermeable foam plastic layer. However, with increased thicknesses of insulation required, the "patting down" method does not work today, because it is necessary to resist the force of the compressed insulation in order to maintain the ventilation space.

Thus, as is evident from the related art, conventional methods are ineffective for maintaining an insulation space that permits adequate ventilation of insulation material.

There thus remains a serious need for an efficient, simple and economic method and system for maintaining an insulation space proximate to thermal or acoustic insulation material in a building.

SUMMARY OF THE INVENTION

The purpose and advantages of the present invention will be set forth in, and be apparent from, the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied and broadly described, the invention includes a spacer device including a body having a plurality of openings defining an openwork, to allow ventilation when placed in contact with insulation material, and a plurality of struts fixedly attached to the body. The struts can be configured to maintain a predetermined distance between a first side of the insulation and an external or internal surface of a building, whereby the body and struts act to define a ventilation space between the unfaced side of the insulation and the building surface facing the insulation.

The spacer device according to the invention can be used with any type of insulated building surface, but it is especially recommended for the bottom face of a roof, an attic floor or wall sheathing, such that a ventilation space is defined between the insulation and the roof, attic floor or wall sheathing.

In accordance with still a further aspect of the invention, the device can be provided in such a form that is capable of being transported and stored as a separate item from the insulation. In accordance with a specific embodiment of the invention, the device is stored in nested layers. Alternatively, the device can be stored in rolled form.

In accordance with another aspect of the invention, a system is provided which includes the spacer device as described herein above, wherein the device is attached to the insulation material, which itself may be fibrous, rigid foam or another type of insulation. The combined spacer device or strut and insulation material construct can be packed face to face, in pairs with the spacing struts facing each other, such that the struts of one assembly penetrates through the openwork body into the insulation material of the other body in the example of fibrous insulation.

In accordance with yet a further aspect of the invention, the struts can be provided with a height of between about 0.25 and 6 inches. More preferably, the struts can be provided with a height between about 0.75 and 3 inches. Even more preferably, the struts can be provided with a height between about 1.0 and 1.75 inches. Most preferably, the struts can be provided with a height of about 1.5 inches.

In accordance with another aspect of the invention, the spacer struts can be formed integrally with the openwork body, or can be attached with adhesive or welded to the body with heat, ultrasonics, solvent bonding, mechanical attachment such as insertion into a tight hole in the body, snapped or secured by an enlarged bulb in the strut or annular rings, or other forms of attachment that can resist the heat and other forces encountered during shipping, storage, deployment and use. The spacer struts, if attached to the body rather than integrally formed with the openwork body can be individual units wherein each strut is formed with an attaching pod of circular, square, or any other geometric shape, or the struts may be part of a body having a plurality of struts attached or formed thereto in the form of a strip or other geometric shape which is attached to the openwork body.

In accordance with a further aspect of the invention, the body and struts can be compressed with the attached fibrous insulation material and packaged into a rolled form. In accordance with this aspect of the invention, the struts can be bent or folded parallel to the body of the device during packaging to take up less space. Moreover, the struts can be provided with a shape memory characteristic such that the struts deploy substantially perpendicular to the body of the device when the insulation is unpackaged by a user.

In accordance with still a further aspect of the invention, a device and method of using the device as generally described herein is provided wherein the body is defined by a plurality of overlapping strips forming a crisscross, parallelogram pattern and defining openings between the strips permitting air circulation. In further accordance with this aspect of the invention, the struts can be mounted at junctures of the strips so as to act as pivot points for the strips. Having the strips pivotally attached to one another, in turn, can permit the width of the ventilation maintenance device to be adjusted to fit one or more width spaces in accordance with a method of the invention.

In accordance with still another aspect of the invention a spacer device is provided including a body having a plurality of openings defining openwork to allow ventilation when placed in contact with insulation material, wherein the body includes a mass of entangled rigid filaments. The body can be configured to maintain a predetermined distance between a first side of the insulation and a building surface, the body acting to define a ventilation space between the first side of the insulation and the surface. Moreover, the body can be configured into a three-dimensional form suitable for nesting multiple devices for shipping and storage. For example, the body can be folded in an accordion fashion.

In accordance with yet another aspect of the present invention, a system is provided which includes a spacer device or strut, as described herein, in combination with an insulation material-fibrous or otherwise. The spacer is disposed proximate to and in contact with the insulation material, wherein the spacer has a plurality of perforations. The spacer permits airflow, and thus ventilation, through the perforations to the insulating material. The spacer can be fixedly attached to the insulation material.

In further accordance with the invention, a method is provided. In accordance with this aspect of the invention, a device for maintaining an insulation space as described herein is provided, and a piece of insulation material (preferably fibrous insulation) is also provided. The method includes the steps of placing the device for maintaining the insulation space proximate to the insulation material, and installing the components into a structure such that the device for maintaining the insulation space is interposed between building structure and the insulation material to permit ventilation of the insulation. Preferably, the device is interposed between exposed fibrous insulation material and the underside of a roof sheathing or the underside of an attic floor. However, the device can be interposed between the thermal insulation material and a wall structure, as desired.

In further accordance with the invention, a method is provided of packaging a device for maintaining an insulation space. The method includes providing a device as herein described, and the step of compressing the device body and struts (if provided) during the packaging process to minimize their profile for stacking or rolling. If the body and struts are pre-attached to the insulation material, they can be compressed with the attached fibrous insulation material and packaged into a rolled form. The method can alternatively or additionally include deploying the insulation material. If struts are provided on the device for maintaining the insulation space, the struts preferably deploy substantially perpendicular to the body of the device when the insulation is unpackaged by a user. Alternatively, if the device is provided in the form of an entangled netting structure, the device can be configured to be rolled up individually upon itself, or in combination with the insulation material.

In further accordance with the invention, an application utilizing the device in interior partitions treated with fibrous acoustical insulation such as in demising partitions between building tenants. In such use, the device may be employed in similar fashion to thermal insulation applications. The mesh body is placed against the fibrous blanket and the points of the spacer struts contact the inside face of the wallboard. This application could be used on one or both sides of the fibrous blanket, forming a void or voids that permit the pulling of wires subsequent to construction of the partition.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system and device of the present invention. Together with the description, the drawings serve to explain the principles of the invention.

DETAILED DESCRIPTION OF THE PREFERRED EMBODIMENTS

Figure 1:
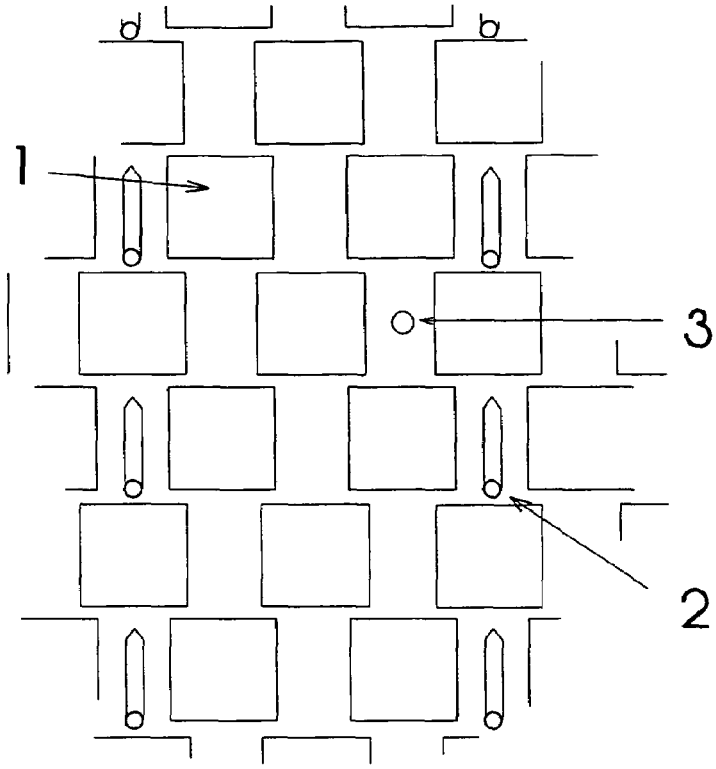
FIG. 1 depicts a first embodiment of a device made in accordance with the invention, wherein the body of the device is die punched and formed from semi-rigid sheet material.

Reference will now be made in detail to the present preferred embodiments of the invention, examples of which are illustrated in the accompanying drawings. The methods and corresponding steps of the invention will be described in conjunction with the detailed description of the preferred embodiments of the invention.

The methods and devices presented herein may be used for maintaining a ventilation space proximate to insulation material such as thermal insulation. The present invention is particularly suited for maintaining a ventilation space proximate to fibrous thermal insulation, but may be applied to other types of insulation material.

Spaces made in accordance with this invention are a significant improvement over existing technology. Such devices are suitable for use in roofs and ceilings where ventilation must be maintained in order to expel heat and moisture from thermal insulation. In fact, the device is suitable for any application involving building surfaces where it is desired to maintain a ventilation space. Devices made in accordance with the invention may be used in cathedral ceiling and roof structures or in flat roof structures. Additionally, devices made in accordance with the invention may be used in roof and wall structures of metal buildings, such as those made from corrugated steel composite materials.

An airspace of approximately one and one-half inches is usually recommended for effective ventilation of roofs through a spacer device made in accordance with the present invention. However, devices made in accordance with the invention can be made to provide any size air space desired. The ever-greater requirements to increase the thickness of insulation and insulation values taxes that regulated air space and requires a more substantial and positive method of maintaining the ventilation space.

Unlike devices of the prior art as described initially above, a spacer device made in accordance with the invention (e.g., as in any of the embodiments described herein) allows thermal insulation to ventilate over its entire area. Moreover, a device made in accordance with the invention can be stored on a construction site with almost no danger of damage, deterioration or wind disbursement, as the openwork configuration permits wind to blow through the devices without moving them. In addition, materials likely to be used to make a device in accordance with the invention (e.g., plastic materials such as PVC, nylon or polyester) are tough and able to resist abuse and UV degradation. In addition, accurate and positive regulation of the insulation vent space offer the possibility of permitting a smaller recommended depth, allowing greater R values to be used, thus resulting in a savings in construction cost. In addition, if a device made in accordance with the invention is attached to insulation material,(e.g., fiberglass blankets) in the factory, the proper and correct use, even for careless or untrained installers, is ensured.

A device made in accordance with the invention can incorporate a flexible mesh or openwork with a plurality of struts attached to, and projecting perpendicularly from, the plane formed by the mesh or openwork. A gridwork backing, where provided, will be almost completely open thereby exposing the entire face of the top of the insulation to the air space to maximize the effectiveness of the ventilation.

Devices made in accordance with the invention can be delivered to the jobsite in a compact bundle of stacked units, in a roll that can be cut to the length required, or pre-attached to the insulation either rolled-up with the insulation or attached to it in straight packaging.

Though particularly advantageous when used in connection with thermal insulation, devices made in accordance with the invention may also readily be applied to insulation material used for other purposes, such as acoustical insulation. Likewise, if a gap is not needed along insulation for air circulation but for another purpose, the invention may advantageously be applied. For example, in a partition having acoustical fibrous blankets for sound-deadening, the device can be used to create a space for the pulling of wires.

As shown in the figures, devices made in accordance with the invention generally include an openwork body that is preferably slightly narrower in width than the distance between building structure framing members (e.g., joists). An openwork body can correspond to a structure wherein sufficient perforations or openings exist through the body to permit transport of air and moisture therethrough. In accordance with one embodiment of the invention, attached and generally perpendicular to the plane formed by the body is a plurality of spacing struts more or less evenly distributed along the planar surface of the body, facing away from the body. The body is placed against the insulating material with the tips of the spacing struts facing away from the insulation such that the struts contact the inside face of the building sheathing or metal roof deck. Moreover, if attachment devices are placed on the opposing planar face of the body, they can anchor into fibrous insulation, facilitating alignment therewith and insulation installation.

In some embodiments, the body of the device may be arranged such that it is not immediately adjacent to the insulation. For example, if struts are arranged on both sides of the body, one set of struts may contact the sheathing or flooring. The other set of struts may either anchor into the insulation, or only press against the insulation; alternatively it can be configured to have a first portion for anchoring into the insulation, and a second portion with increased cross-sectional area for resting against the insulation and preventing penetration therethrough.

Alternatively still, two bodies may be provided, with struts creating an air space therebetween. In such an arrangement, one body rests on the sheathing or flooring, and the other body rests on the insulation.

For purpose of illustration and not limitation, a first embodiment of device made in accordance with the present invention is illustrated in FIG. 1. In accordance with this embodiment of the invention, a body is provided with an open mesh structure, where spacing struts are integral with the mesh. Specifically, a body with perforations 1 is provided and can be die cut from flexible plastic sheet, or other material. The spacing struts 2 are cut and bent (or alternatively preformed) to be oriented in a direction generally perpendicular to the perforated body 1. In accordance with one embodiment of the invention, a possible location for an attachment device to secure the device to fibrous insulating materials is indicated by reference numeral 3.

Figure 2:
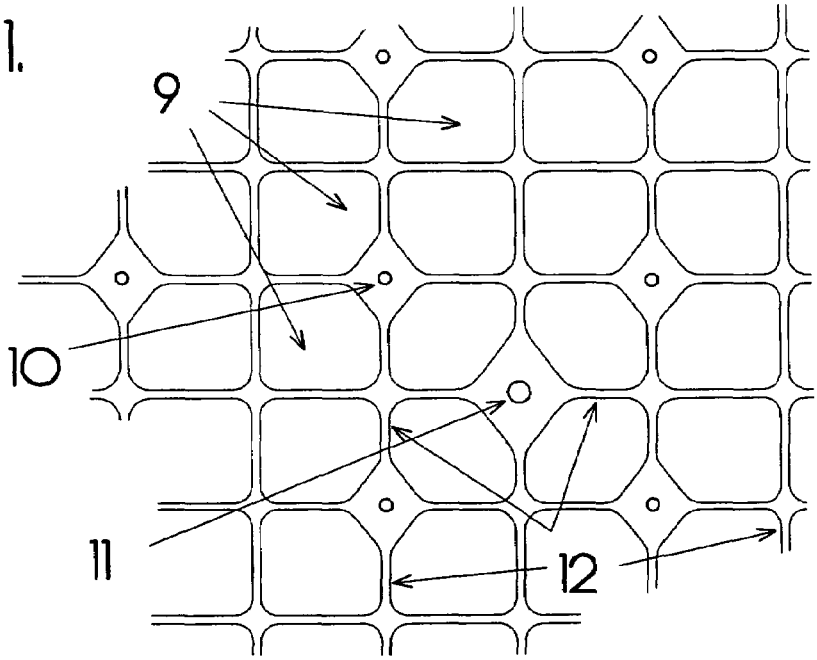
FIG. 2 depicts a second embodiment of a device made in accordance with the invention, wherein the body of the device is cast in a mould.

The patterns of openings in the embodiments depicted in FIGS. 1 and 2 are only a suggestion of possible mesh configurations. Many configurations are possible, and within the scope of the invention. By way of example, three dimensional meshes and/or patterns based on different geometric patterns (e.g., triangles, hexagons circles, polygons, etc.) are all possible.

The struts can be manufactured by punching by a die from flexible plastic sheet along with the ventilation holes, or they can be cast-molded along with the flexible mesh body as illustrated in FIG. 2, or composed of separate strips or filaments that are fused, glued or woven to the body. Suitable materials, by way of example plastic materials, plastic coated paper or cellulose and/or metallic or composite materials can be used. The material used should be able to maintain its rigidity under various loading, moisture and temperature conditions in order to maintain the ventilation space when in use.

FIG. 2 is a plan view of a mesh body which is cast or formed from flexible material with the spacing struts 10 integrally formed with the openwork body or formed separately and attached thereto. Openings 9 are defined by elongate filaments 12 forming the openwork body permitting ventilation therethrough. A possible attachment location 11 is also provided for an attachment device as discussed below with regard to the embodiments of FIGS. 4-5. Attachment point 11 can be, for example, a hole for insertion of a separate attachment device or an attachment device which is formed integrally with the mesh body.

Figure 3:
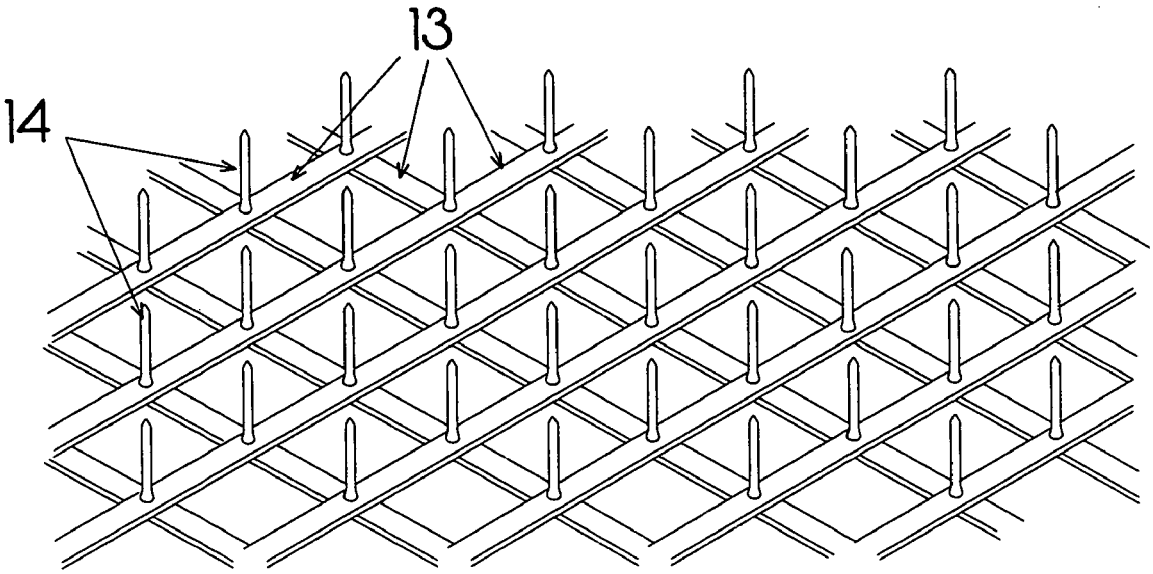
FIG. 3 depicts a third embodiment of a device made in accordance with the invention, wherein the body of the device is composed of semi-rigid strips.
Figure 9:
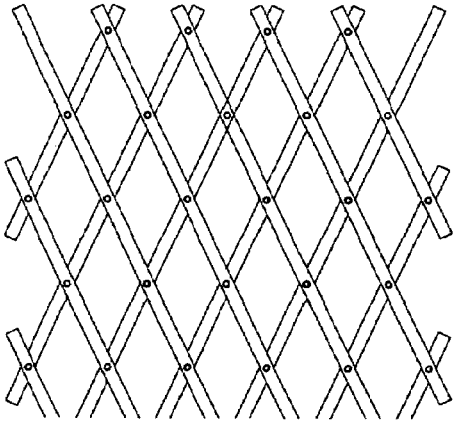
FIGS. 9 and 10 illustrate the embodiment of FIG. 3 in various configurations.
Figure 10:
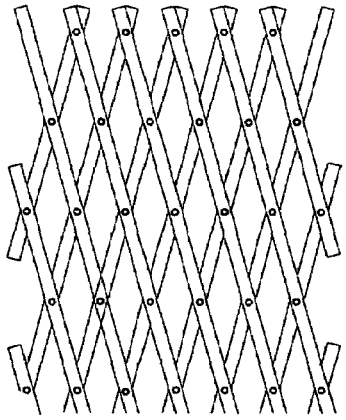

For purpose of illustration and not limitation, another embodiment of the spacer device, made in accordance with the present invention, is illustrated in FIG. 3. This embodiment of the invention includes a body having flexible strips 13 assembled in a crisscross, parallelogram type orientation with spacing struts 14 acting as pivot points for the parallelogram-oriented strips. Strut pins, alternatively, may be separate from the body strips, with the struts inserted at each pivot point. This particular embodiment of the invention can provide for a device having an adjustable width that can be altered prior to installation to accommodate rafter or joist spacings of any desired dimension as shown on FIG. 9 and FIG. 10. Adjustment can be achieved by pulling or pushing laterally on the body member, causing the openwork to expand or contract respectively. For purpose of illustration and not limitation, FIGS. 9 and 10 illustrate use of a device made in accordance of this aspect of the invention and its appearance when adjusted for rafter spacings (e.g., from 12" to 24"). However, it is to be understood that other widths (both narrower and wider) are within the scope of the invention including, for example, 0.5, 1.5, 2.5, 3.0, 3.5, 4.0, 4.5, and five feet.

Figure 11:
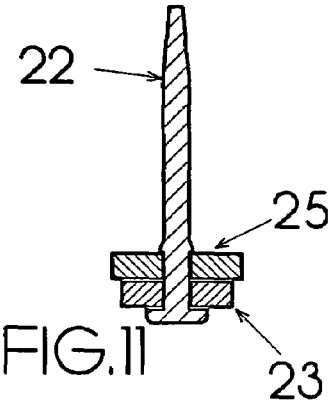
FIGS. 11 and 12 each illustrate different embodiments of a portion of a device made in accordance with the embodiment of the invention shown on FIG. 3 and FIGS. 9 and 10.
Figure 12:
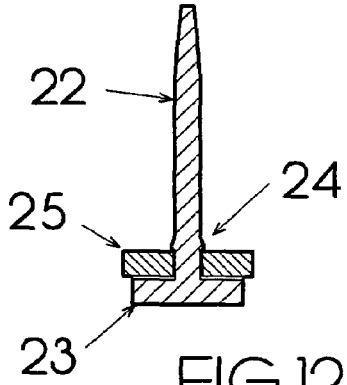

The strut pins shown in FIG. 11 and FIG. 12 can additionally be provided with an enlarged diameter 24 at a specific point along the shaft to allow for snap together assembly. The strut pins can also be integral to one set of strips as illustrated in FIG. 12. In accordance with this aspect of the invention, FIGS. 11 and 12 illustrate two exemplary versions of the spacer struts 22 with a bulge or "barb" 24 to facilitate assembly. FIG. 11 illustrates an independent pin that extends through two body strips (23 and 25) and FIG. 12 depicts the pin integral to a single body strip component.

It will be understood that while the spacer struts shown in FIG. 3 and in FIGS. 11 and 12 are illustrated as having the shape of round dowels, such struts can be made in any convenient shape, including that of flat strips of various widths and thicknesses, hollow tubes, bent wires, etc. All of such shapes are contemplated by the present invention.

Figure 4:
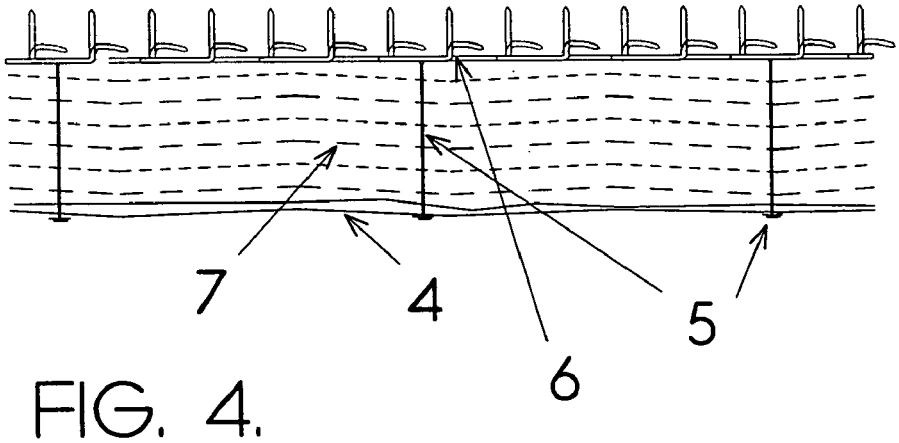
FIG. 4 is a sectional view of the embodiments of a device made in accordance with the invention, illustrating a filament means of attachment of the device to a fibrous insulation blanket.

For purpose of illustration and not limitation, as embodied herein and as illustrated in FIG. 4, an additional embodiment of the invention is provided. FIG. 4 depicts a sectional view through an insulation batt or blanket for factory attachment of a device made in accordance with the invention by using one or more filaments 5. The filaments 5 preferably extend entirely through the insulation mass 7 from the inner surface of the insulation batt 4 (usually made of paper or an aluminum foil and paper composite layer or a plastic material) to the device made in accordance with the invention. A button-like enlargement on the end of the filament prevents pull-out.

Figure 5:
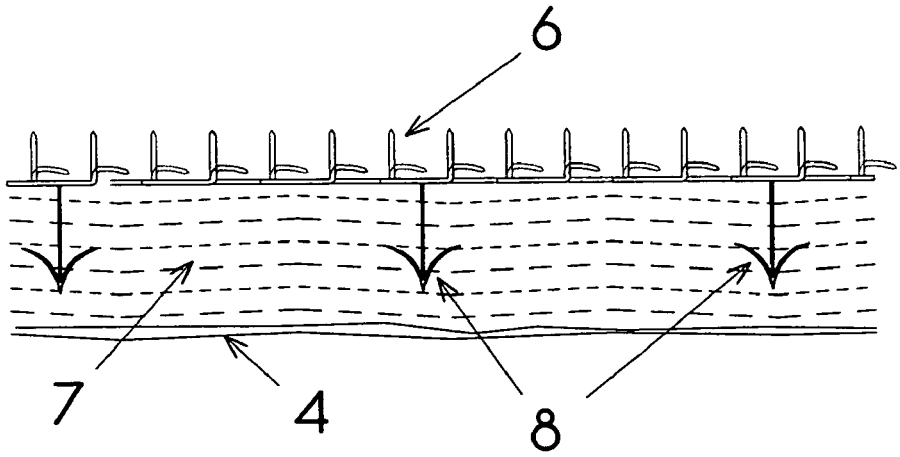
FIG. 5 is a sectional view of the embodiments of a device made in accordance with the invention utilizing a harpoon shaped device for attachment of the device to a fibrous insulation blanket.

For purpose of illustration and not limitation, a sectional view is provided in FIG. 5 depicting an insulation batt in combination with a device for facilitating attachment. As depicted in FIG. 5, strategically placed flexible "harpoons", integral with, or attached to the device's body, are utilized. Reference numeral 6 indicates the ventilation device with spacer struts, shown in both the deployed and bent-over positions. Reference numeral 7 indicates the fibrous insulation mass, and reference numeral 8 indicates the "harpoon" type fastening devices. Hot melt glue and other adhesives or attachment devices of other configurations could also be used to provide attachment between device 6 and the fibrous insulation material 7, as can other mechanical fasteners. For example, if the device is used with rigid foam insulation, the device can be simply screwed into the foam. If used with fibrous insulation, hooks can be applied to the side of the device adjacent the insulation to engage the fibers of the insulation, thereby attaching the components. Moreover, the openwork body can alternatively be interwoven with the fibers of the insulation batt.

Figure 6:
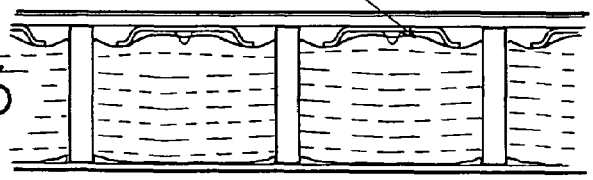
FIG.6 Prior Art
FIG. 6 is a sectional view through several bays of roof structure and insulation illustrating the prior art Rafter-Vent product used in a first orientation.
Figure 7:
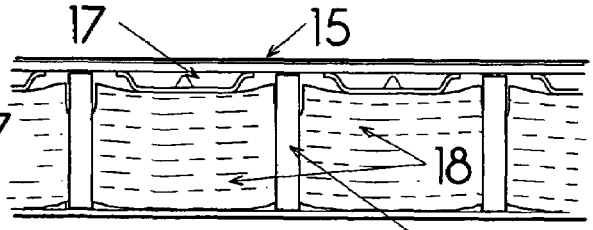
FIG.7 Prior Art
FIG. 7 is a sectional view through several bays of roof structure and insulation illustrating the prior art Rafter-Vent product used in a second orientation.
Figure 8:
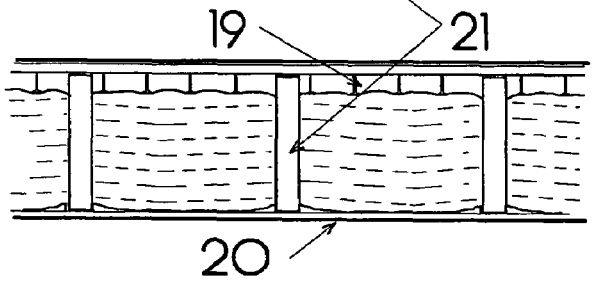
FIG. 8 is a sectional view through several bays of roof structure and insulation illustrating use of a device made in accordance with the invention.

For purpose of illustration and not limitation, as embodied herein, FIG. 8 depicts a transverse sectional view through several bays of roof structure and insulation illustrating an exemplary embodiment of the invention 19 demonstrating its effectiveness at maintaining a uniform air space in comparison with FIGS. 6 and 7 depicting the Rafter-Vent product. The openwork body of the device 19 exposes almost the entire insulation surface to air movement. Reference numeral 20 depicts the finished ceiling, usually made of gypsum board or plaster on lath.

Figure 13:
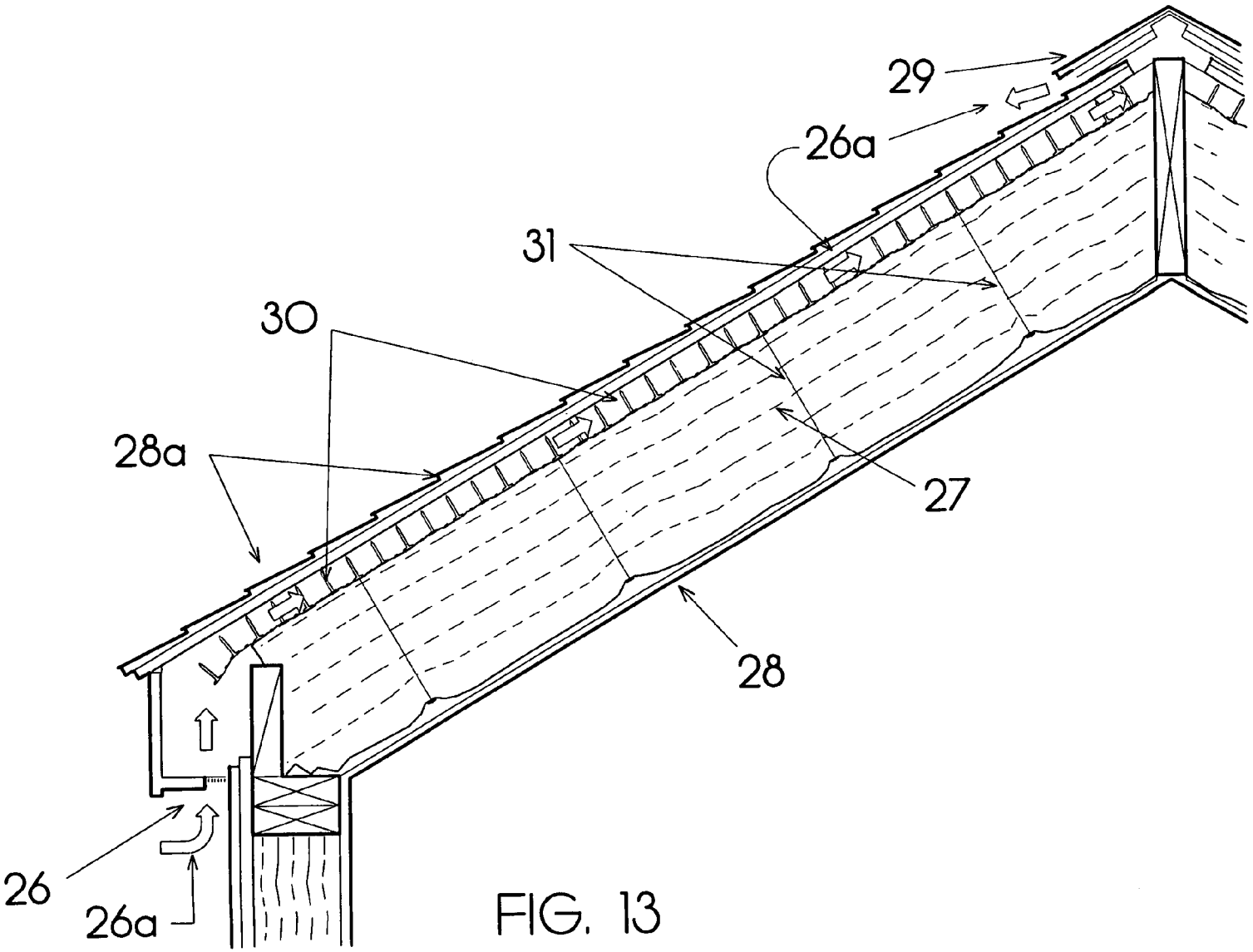
FIG. 13 illustrates a "cathedral" type ceiling roof structure utilizing a device made in accordance with the invention.

For purpose of illustration and not limitation, FIG. 13 illustrates a longitudinal section through a "cathedral" ceiling roof structure showing how an exemplary ventilation device 30 made in accordance with the invention provides continuous ventilation of the insulation 27 from the eave vent inlet 26, to a ridge vent 29 or another upper outlet device. Reference numeral 28 depicts the finished ceiling.

Figure 14:
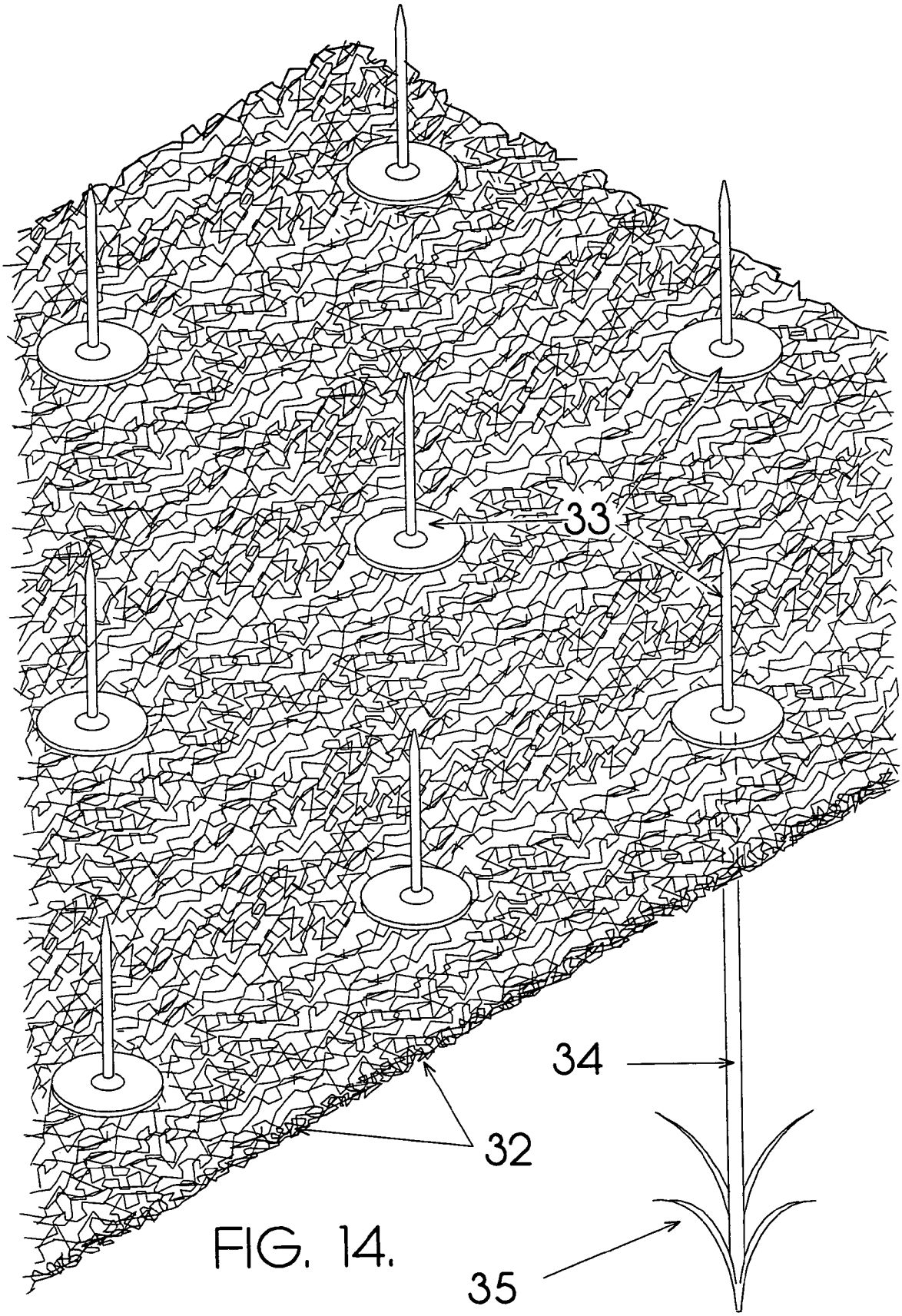
FIG. 14 illustrates a fourth embodiment of the device made in accordance with the invention.
Figure 15:
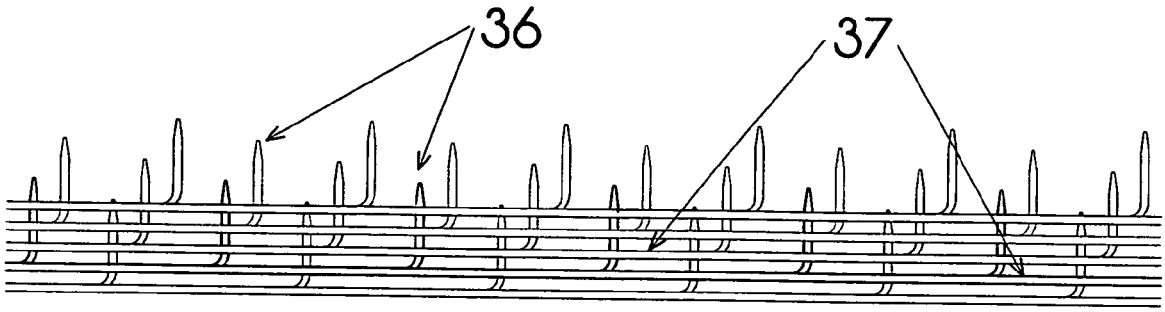
FIG. 15 depicts the nesting ability of the device made in accordance with the invention.

By way of further illustration and not limitation, another embodiment of device made in accordance with the present invention is illustrated in the isometric view in FIG. 14. This embodiment of the invention is made with "entangled net technology", a commercially available product which has been rolled to a precise thickness of open mesh after disbursement of extruded plastic filaments. This embodiment, made in accordance with the present invention, has a body of "entangled net" sheet 32 with spacer struts 33 having enlarged bases for fused or glued attachment to the body. Strategically located filament or harpoon anchors are attached in similar manner to the spacer struts, but on the opposite side of the body 34, 35 for attachment of the device to fibrous insulation. These attachment methods probably would not be used where the devices are delivered to a construction site without insulation.

The "entangled net" system is available commercially from Enka Geomatrix Systems, a Division of BASF Corporation of Enka, N.C., and its successor, Colbond, Inc. U.S. Pat. No. 4,212,692 discloses a method of forming the "entangled net" material. U.S. Pat. Nos. 5,960,595 and 6,487,826 utilize this product in areas of roof ventilation at the eave and ridge only. These patents are expressly incorporated by reference herein.

In further accordance with the invention, a method is provided. In accordance with this aspect of the invention, a device for maintaining an insulation space as described herein is provided, and thermal insulation material (preferably fibrous insulation) is also provided. The method further includes the steps of placing the device for maintaining the insulation space proximate to the insulation material, and installing the components into a structure such that the device for maintaining the insulation space is interposed between building sheathing and the insulation material to permit ventilation of the insulation. Preferably, the device is interposed between exposed thermal insulation material and the underside of roof sheathing or the underside of an attic floor. However, the device can be interposed between the thermal insulation material and wall sheathing, as desired. Any of the devices described herein can be used in accordance with the method of the invention.

Figure 16:
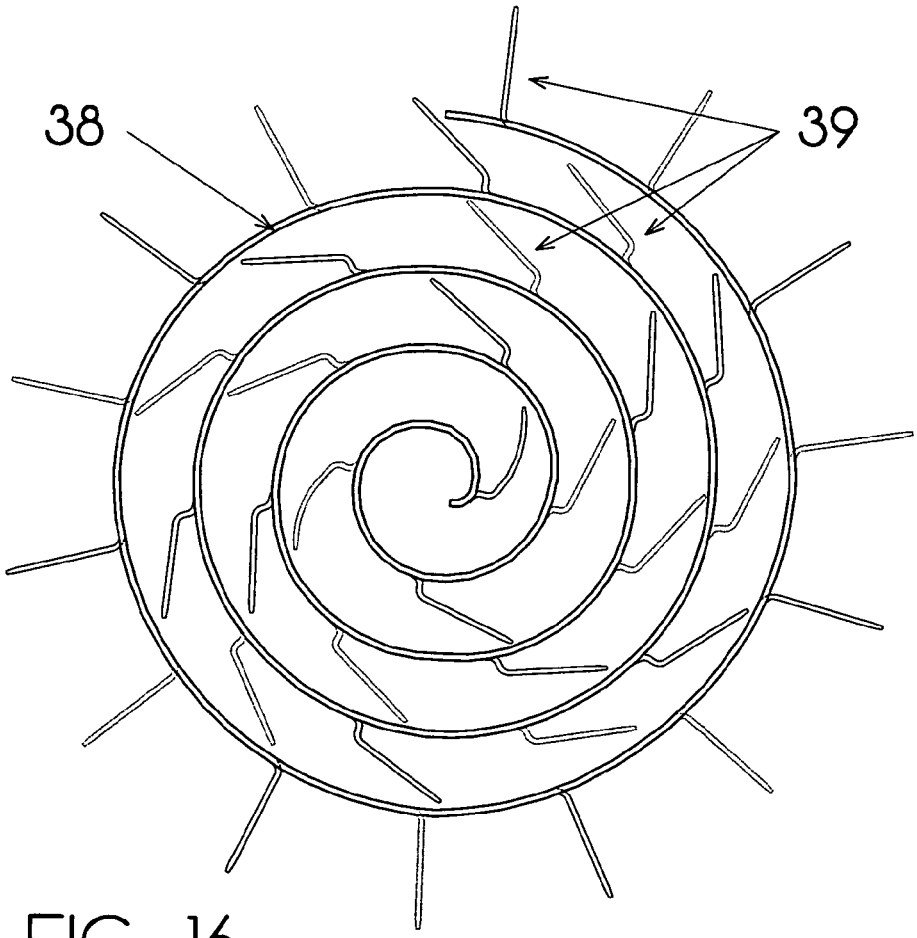
FIG. 16 illustrates the ability of the device, made in accordance with the invention, to be coiled into a roll for compact packaging or storage.
Figure 18:
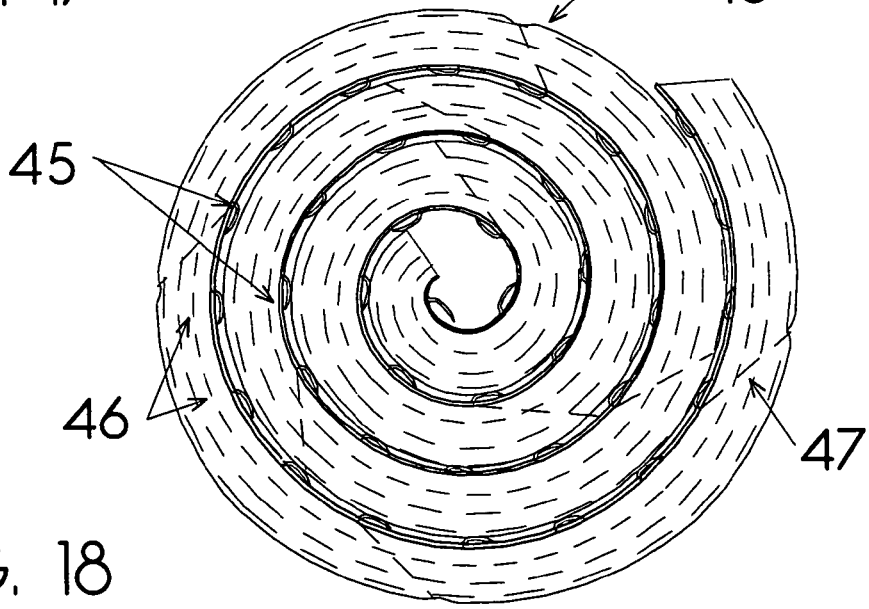
FIG. 18 illustrates the ability of the device, made in accordance with the invention and when attached to fibrous insulation, to be coiled into a roll for packaging or storage.

In further accordance with the invention, the device as herein described, such as the device depicted FIGS. 1 and 3, may be bundled for storage and transportation by compressing the device body 38 and struts 39 as illustrated in FIG. 16, to minimize their profile for stacking or rolling. If the device is pre-attached to the insulation material as depicted in FIGS. 4 and 5, the struts can be compressed with the attached fibrous insulation material and bundled into a rolled form, as illustrated in FIG. 18. The method can alternatively or additionally include deploying the insulation material. If struts are provided on the device for maintaining the insulation space, the struts preferably deploy substantially perpendicular to the body of the device when the insulation is unpackaged by a user.

Figure 17:
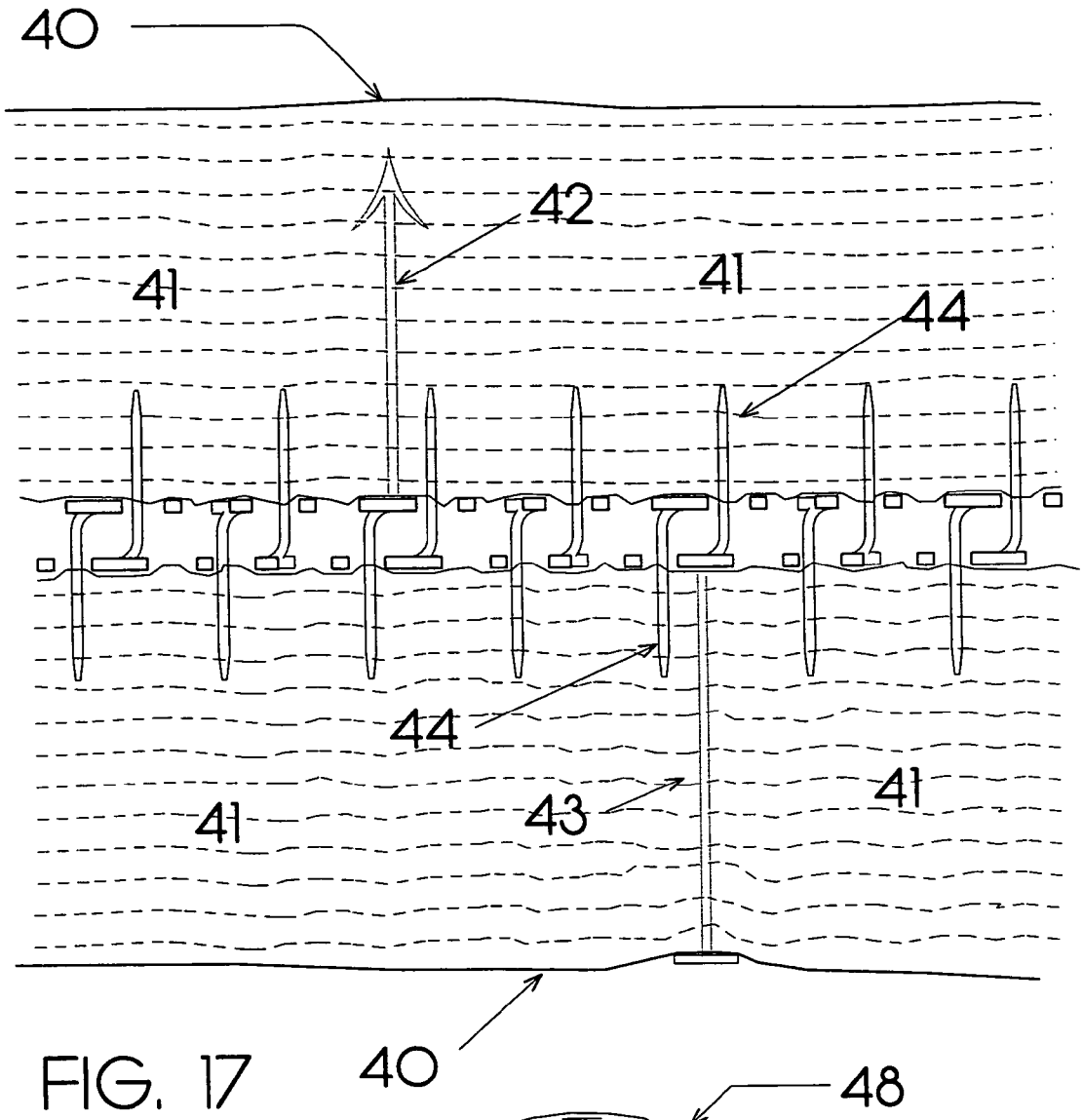
FIG. 17 illustrates the ability of the device, made in accordance with the invention when attached to fibrous insulation blankets, to be packaged or stored, with spacer studs facing each other.

Alternatively, the device attached to the fibrous insulation blankets as shown in FIG. 17, may be packaged in straight bundles wherein the spacer struts 44 face each other and the struts of one insulation blanket's ventilation device penetrates through the other blanket's ventilation device mesh body into the mass of the fibrous blanket opposite. Conversely, the struts of the opposing assembly does the same. This pair of blankets is compressed and packaged with a plurality of other paired sets.

Moreover, it is to be remembered that a device made in accordance with the invention can also be used wherever it is desired to maintain a ventilation space, or similar voids for other purposes, including walls of structures, interior acoustically dampened partitions, or alternative applications such as automotive, marine, aviation or aeronautical applications.

Figure 19:
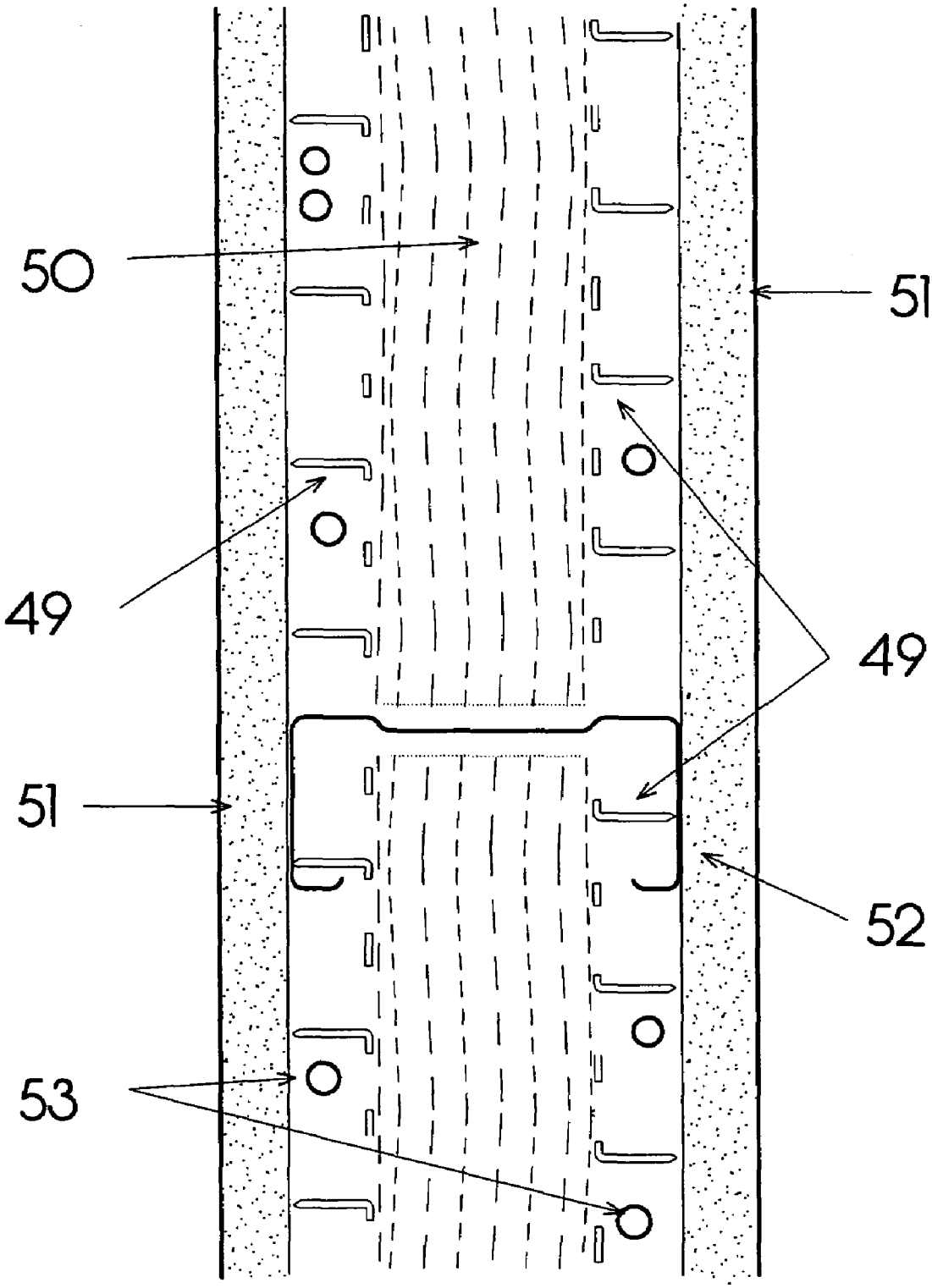
FIG. 19 is a horizontal section through an acoustically treated partition showing another use for the device.

In FIG. 19 which illustrates a horizontal section through an acoustically dampened interior partition, illustrates the device 49 being deployed on one or both sides of the fibrous acoustical insulation 50. The points of the struts contact the inner face of the wallboard finish. 52 points to a wall framing member, and 53 indicates wiring that can easily be pulled for communication, and other purposes after the construction of the partition.

It will be apparent to those skilled in the art that various modifications and variations can be made in the method and system of the present invention without departing from the spirit or scope of the invention. Thus, it is intended that the present invention include modifications and variations that are within the scope of the appended claims and their equivalents.

What is claimed is:

1. A system for maintaining a defined space between insulation material and a building surface in a structure, comprising:

(a) an interior building surface facing inwardly toward the interior space of a building;

(b) insulation material disposed proximate and parallel to the interior building surface; and (c) a spacer device interposed between the interior building surface and the insulation material, the spacer device acting to maintain an air space between the interior building surface and the insulation material, the spacer device including a body having a plurality of openings defining an openwork to allow the passage of air through the air space when placed in contact with the insulation material to facilitate heat and moisture transfer between the insulation material and air in the air space.

2. The system of claim 1, wherein the interior building surface is selected from the group consisting of a bottom face of a roof, the bottom face of an attic floor, the interior face of wall sheathing and the interior surface of a soundproofed interior partition comprising two paralleled wall boards with fibrous acoustic insulation therebetween.

3. The system of claim 1, wherein the spacer device is capable of being transported and stored as an independent item, separate from the insulation material.

4. The system of claim 3, wherein the spacer device is configured for transportation and storage in nested layers.

5. The system of claim 3, wherein the spacer device is configured to be rolled for transportation and storage.

6. The system of claim 1, wherein the insulation material is fibrous, and the spacer device is attached to the insulation material.

7. The system of claim 6, wherein the spacer device includes a plurality of spacer struts extending outwardly from the body, and the combined spacer device and insulation material is packed face to face, in pairs, with pluralities of said spacer struts facing each other, wherein struts attached to one piece of insulation material penetrate through the openwork body into the insulation material of the other piece.

8. The system of claim 6, wherein the spacer device includes a plurality of spacer struts extending outwardly from the body, and the body and spacer struts are compressed with the attached fibrous insulation material and rolled to form a bundle for transportation and storage.

9. The system of claim 8, wherein the spacer struts are bent parallel to the body of the spacer device in the rolled bundle.

10. The system of claim 9, wherein the spacer struts have a shape memory and wherein the spacer struts deploy substantially perpendicular to the body of the device when the bundle is unrolled by a user.

11. The system of claim 2, wherein the spacer device is deployed on at least one side of the fibrous acoustic insulation, thereby creating open spaces for the subsequent pulling of wires.

12. The system of claim 2, wherein the spacer device is deployed on both sides of the fibrous acoustic insulation.

13. The system of claim 1, wherein the spacer device further includes a plurality of spacer struts fixedly attached to said body, the struts configured to maintain a predetermined distance between a first side of the insulation material and the interior building surface, the body and struts cooperating to further define and maintain the air space.

14. The system of claim 13, wherein the spacer struts have a height between about 0.25 and 6 inches.

15. The system of claim 13, wherein the body is composed of a sheet of entangled rigid filaments, the body acting to define a ventilation space between the first side of the insulation material and the tips of spacer struts attached thereto.

16. The system of claim 13, wherein the spacer struts are formed integrally with the openwork body.

17. The system of claim 13, wherein the spacer struts are formed separately from the openwork body and attached thereto.

18. The system of claim 17, wherein the spacer struts are attached to the openwork body by means selected from the group consisting of a weld, an adhesive, a forced fit and an enlargement on the spacer strut which retains the strut in an opening in the body.

19. The system of claim 13, wherein the spacer struts have a cross-sectional shape selected from the group consisting of circular and rectangular.

20. A spacer device suitable for spacing insulation material from a building surface, the device comprising:

(a) a body having a plurality of openings defining an openwork to allow the passage of air therethrough when placed in contact with the insulation material wherein the body is defined by a plurality of crisscrossing strips forming a parallelogram pattern; and (b) a plurality of spacer struts fixedly attached to said body, the struts configured to maintain a predetermined distance between a first side of the insulation material and the building surface, the body spacer and struts acting to define and maintain a space between the first side of the insulation material and the building surface.

21. The device of claim 20, wherein the spacer struts are mounted at junctures of the strips so as to act as pivots for the strips.

22. The device of claim 21, wherein the spacer device can be adjusted in width to fit a plurality of different width spaces.

23. The device of claim 21, wherein the spacer device can be adjusted to widths in the range of 12 and 36 inches.

24. A method of using a spacer device to maintain a defined space between insulation material and an interior building surface facing inwardly toward the interior space of a building, wherein the spacer device includes a body having a plurality of openings defining an openwork to allow the passage of air therethrough when placed in contact with the insulation material, the spacer device being configured to maintain a predetermined distance between a first side of the insulation material and the building surface; said method comprising the steps of:

(a) placing the spacer device on a first side of a section of insulation material; and (b) installing the insulation material, together with the spacer device, adjacent an interior building surface with the spacer device disposed between the first side of the insulation material and the interior building surface, whereby the spacer device defines and maintains an air space between the first side of the insulation material and the building surface to facilitate heat and moisture transfer between the insulation material and air in the air space.

25. The method of claim 24, wherein the building surface is selected from the group consisting of a bottom face of a roof, an attic floor, wall sheathing and a soundproofed interior partition comprising two paralleled wallboards with fibrous acoustic insulation therebetween.

26. The method of claim 25, wherein the spacer device further includes a plurality of spacer struts fixedly attached to said body, the struts configured to maintain a predetermined distance between a first side of the insulation material and the interior building surface, the body and struts cooperating to further define and maintain the air space.

* * * * *